United States Patent [19]

De Fazio

[11] Patent Number: 4,809,467

[45] Date of Patent: Mar. 7, 1989

[54] FLEXIBLE GRINDING DISK AND GRINDING METHOD

[75] Inventor: Thomas L De Fazio, Watertown, Mass.

[73] Assignee: The Charles Stark Draper Laboratory, Inc., Cambridge, Mass.

[21] Appl. No.: 7,949

[22] Filed: Jan. 28, 1987

[51] Int. Cl.[4] ..... B24D 17/00

[52] U.S. Cl. ..... 51/358; 51/378; 51/394; 51/401; 51/206 NF

[58] Field of Search ..... 51/358, 376, 377, 378, 51/389, 394, 395, 397, 401, 402, 281 R, 328, 309, 209 R, 206 NF

[56] References Cited

U.S. PATENT DOCUMENTS

| | | | |
|---|---|---|---|
| 302,952 | 8/1884 | Smith | 51/378 |
| 3,638,567 | 8/1972 | Ali | 51/358 |
| 4,164,098 | 8/1979 | Akita | 51/209 R |
| 4,381,925 | 5/1983 | Colleselli | 51/309 |

*Primary Examiner*—Frederick R. Schmidt
*Assistant Examiner*—Maurina Rachuba
*Attorney, Agent, or Firm*—Joseph S. Iandiorio; Douglas E. Denninger

[57] ABSTRACT

Grinding disk and method for finishing a workpiece having irregularities thereon, having a highly flexible inner portion and an outer annular face portion having sufficient flexibility to enable such annular portion to be substantially deformed by the irregularities of said workpiece upon contact therewith.

17 Claims, 3 Drawing Sheets

FLEXIBLE GRINDING DISK AND GRINDING METHOD

FIELD OF INVENTION

This invention relates to the field of flexible grinding disks and methods of utilizing such disks.

BACKGROUND OF INVENTION

When peripheral flexible toe portions of a grinding disk are deflected by contact with a workpiece, restoring forces tending to straighten the peripheral portion are applied to the disk. The restoring forces have a first component which is proportional to the static flexural stiffness of the disk transverse to the plane of the disk, and a second disk membrane component proportional to the centrifugal forces induced in the plane or membrane of the disk by virtue of rotation. When the second force component is substantially larger than the first component, that is, when operating speeds are relatively high, good workpiece finishes result. However, maintaining this condition of dominant membrane forces requires deliberate effort of a skillful operator of the disk grinder. An important application of the invention is in the field of robotics, where the robot does not inherently have a particular skill level for performing the grinding operation. Where the invention is utilized by a human operator, reduction of the level of required skill is also desirable.

SUMMARY OF INVENTION

Thus it is an object of this invention to provide a novel flexible grinding disk and method of employing the disk in grinding operations.

It is a further object of this invention to reduce or eliminate the skill required by a human operator to manipulate a standard disk-grinder, so that disk membrane forces dominate the static stiffness forces to produce an acceptable finish on the workpiece.

It is a further object of this invention to provide novel flexible grinding disks designed to extend the operational range of dominance of centrifugally-induced disk membrane forces.

It is further object of the invention to enable the automation of the grinding operation to develop smooth compound-curved surfaces having esthetically acceptable finishes.

These desirable objects are attained by providing a grinding disk having a highly flexible inner portion and an outer flexible annular face portion with an abrasive surface thereon, the outer annular face portion having sufficient flexibility to enable the outer annular portion to be substantially deformed by flaws upon a workpiece in contact therewith.

In a preferred embodiment the outer annular portion has a substantially greater average density than inner portions and radially extending reinforcing elements are provided in the disk plane to enable very high speed disk rotation. Circumferentially extending reinforcing elements may also be provided. A preferred method of using the disks involves maintaining certain inter-relationships between the operating parameters of the system.

DISCLOSURE OF PREFERRED EMBODIMENTS

Other objects, features and advantages will occur from the following description of preferred embodiments and the accompanying drawings in which.

Figure 1A:
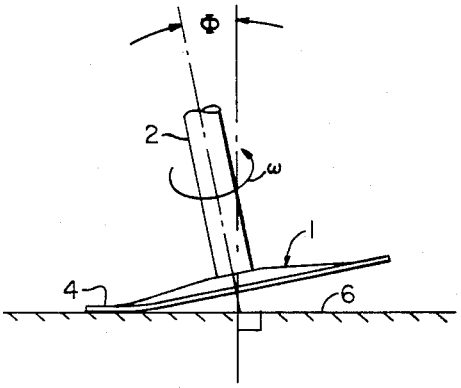
FIG. 1A PRIOR ART
FIG. 1A is a schematic elevational view of a conventional flexible grinding disk applied to a workpiece.
Figure 1B:
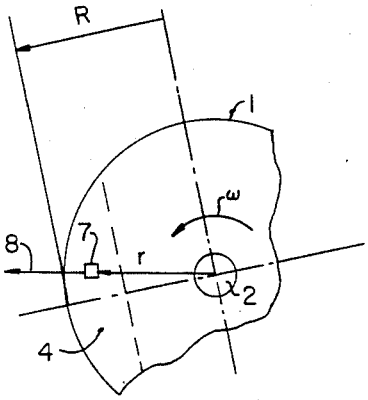
FIG. 1B PRIOR ART
FIG. 1B is a partial top plan view of the grinding disk of FIG. 1A.
Figure 2:
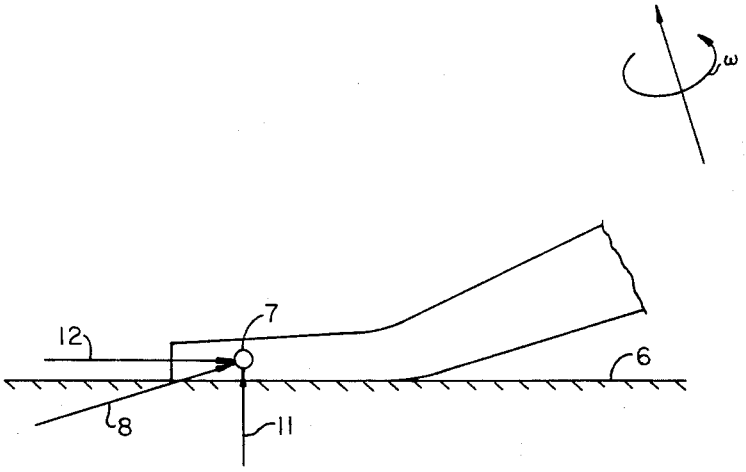
FIG. 2 PRIOR ART
FIG. 2 is an enlarged view of the toe portion of the grinding disk of FIG. 1A.
Figure 3:
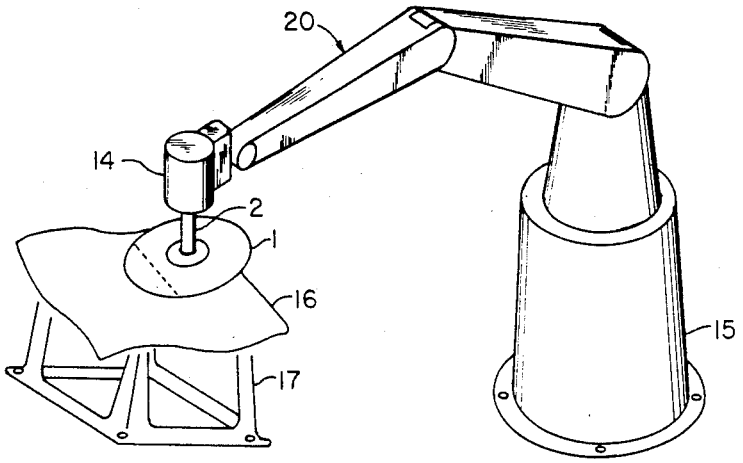
FIG. 3 PRIOR ART
FIG. 3 is a schematic axonometric view of a robot operating a conventional grinding disk.
Figure 4:
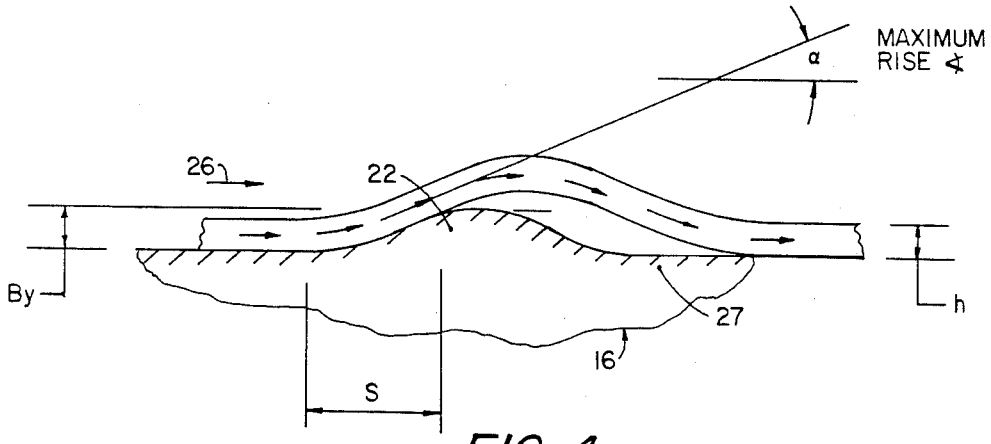
FIG. 4 PRIOR ART
FIG. 4 illustrates a portion of a flexible grinding disk in contact with a surface flaw.

In FIG. 1A, flexible grinding disk 1 is coupled to drive shaft 2, rotated at an angular velocity $\omega$, and toe portion 4 is illustrated in contact with a portion of a workpiece 6. In FIG. 1B, a centrifugal force 8 operates upon a small element 7 in the flat toe or region of the disk in contact with the workpiece. FIG. 2 shows the resolution of reaction force 8 upon element 7 into two components. Component 11 of the reaction force of vector 8, is provided by the surface force of the workpiece due to disk deflection, whereas component 12 is provided by membrane tension due to rotation. The greater the spin speed of the disk, the greater the centrifugal component of force upon element 7, and hence the greater vector component 12. In accordance with the method of the invention, the rotational speed of the grinding disk is deliberately kept high. FIG. 3 illustrates disk 1 coupled to a motor 14 via driveshaft 2, the motor in turn is coupled to frame 15 of a robot, for example, through a positioning device 20, the details thereof forming no part of this invention, and a workpiece 16 is positioned upon a base member 17. A schematic view of a cross-section of the grinding disk contacting a lump or flaw 22 in the surface 27 of workpiece 16, is illustrated in FIG. 4. The disk moves in the direction indicated by arrow 26, so that the flexible outer annular portion of disk 1 "climbs" over the bump 22 as shown. The bump or flaw 22 may be characterized by its height $B_Y$ above the planar surface 27 of the workpiece, and the maximum slope where disk contact exists is represented by the maximum rise angle $\alpha$. The length of contact of the grinding disk with the flaw is represented by S. Other parameters of significance are the disk thickness h illustrated in FIGS. 2 and 4, and the disk outer radius R illustrated in FIG. 1B, along with the effective grinding radius r in FIG. 1B. Our instrumentation of the determination of r, as a vector, is the force-weighted location of the centroid of the contact area. It is described in some detail in U.S. Pat. No. 4,523,409 in column 4, line 57 to end-of-column plus column 5, line 1 to 6. The coordinate system relevant to this description is shown in FIG. 9 of U.S. Pat. No. 4,523,409.

Figure 5:
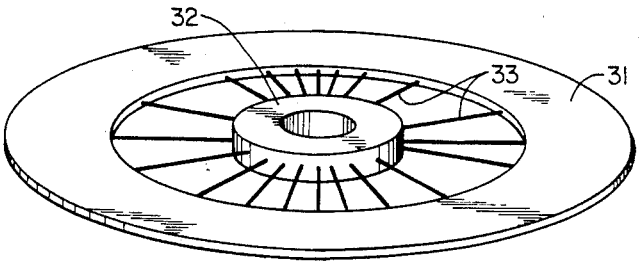
FIGS. 5, 6A, 6B and 7 illustrate embodiments of the novel grinding disk of the invention.

FIG. 5 illustrates a first embodiment of the novel grinding disk of the invention, wherein outer annular disk portion 31 is coupled to central hub portion 32 via filamental, elongated members 33 having a spoke-like configuration. Owing to members 33, the disk has high static flexibility in a direction perpendicular to the plane of the disk. An outer portion 31 bears abrasive material on its face. While the outer annular portion 31 is less flexible than the inner portion of the disk occupied by filaments 33, it has sufficient flexibility to enable it to be substantially deformed by the surface bumps or irregularities as illustrated in FIG. 4. Preferably, the outer portion 31 of the disk also has a substantially greater average density than the inner portion, which is occupied by the thin filamental elements 33. The radially extending filamental elements or reinforcing members 33, and/or circumferentially disposed filamental strengthening members bonded into the medial or neutral plane of the outer annular portion 31 provide an increased membrane disk strength to enable the disk to be driven at very high spin speeds without being torn apart by centrifugal forces within the disk, while the aforesaid flexural stiffness in directions perpendicular to the plane of the disk is maintained low due to lack of constraint of the filaments 33, or due to the location in the neutral or medial plane within abrasive portion 31 of radial or circumferential filaments, if any.

Figure 6A:
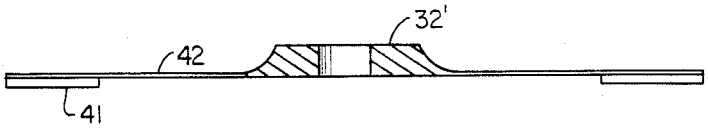
Figure 6B:
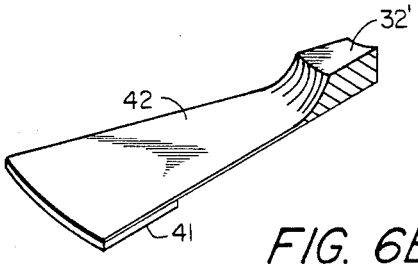
Figure 7:
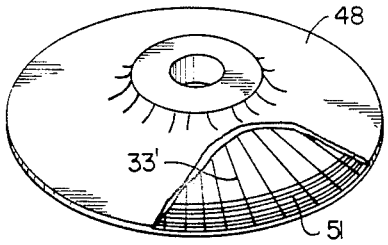

In FIGS. 6A and 6B, an abrasive filled outer annular polymer portion 41 is mounted upon a shim-like, thin, inner disk portion 42 which in turn is affixed to central hub 32'. Because of the thinness of disk portion 42, the flexural or lateral stiffness is maintained low and yet the membrane strength of the disk in the plane of disk portion 42 is high, to permit high speed rotation of the disk without the disk being pulled apart. Since the outer portion 41 is substantially thicker than the thin inner disk portion 42, the outer annular portion is weighted relative to the inner portion. Also, the flexibility of outer annular portion 41 is less than the flexibility of the inner portion 42, and yet is sufficiently flexible to enable the outer portion to be substantially deformed by the bumps or flaws upon the workpiece as illustrated in FIG. 4. In FIG. 7, a disk 48 of outwardly-apparently-conventional construction is shown but in fact differing from conventional construction by virtue of radial filamental reinforcement 33', revealed in partial cutaway of disk 48, and circumferential filamental reinforcement 51 located in or about the neutral or medial plane of the disk and possibly by virtue of enhanced compliance of the polymeric or other matrix material of the disk.

The beneficial results of the invention discussed above are attained by mounting the novel disks of FIGS. 5 through 7 upon the apparatus of FIG. 3 or in manual or other automated grinding apparatus and grinding the workpiece, while maintaining preferred inter-relationships between the various operating parameters of the system. As illustrated in FIG. 2, flexure is resisted by dynamically-induced membrane forces and by static flexural stiffness. Flexure resistance is determined by disk and disk-use parameters such as diameter, thickness, elastic and mass properties, spin-speed, contact-patch location, and the degree of disk deformation. If a disk-grinder is operated so that membrane forces dominate flexural stiffness, certain relationships exist between workpiece and grinding parameters, including disk radius, grinder-spin-axis to surface-normal angle, flaw characteristic width, and finished shape surface height and slope deviations of the work surface. Acceptable finishes result from the combination of membrane-force-dominant operation and proper choice of disk diameter, speed, and axis-to-normal angle.

The novel grinding disks such as those illustrated in Figs. 5–7, are preferably applied to the workpiece in a manner to satisfy both of the following inequalities:

$$\left(\frac{E}{9\rho}\right)\left(\frac{h}{r^2\omega}\right)^2 (n^2-4) << 1; \text{ and} \tag{1}$$

(2) $\Phi$ is less than the lesser of the following two bracketed terms;

$$\left[\frac{2B_yR}{S^2}, \frac{\alpha R}{S}\right] \tag{2}$$

where:

E = elastic modulus of the disk;
$\rho$ = disk density;
h = disk thickness;
r = effective grinding radius;
$\omega$ = angular velocity;
n = flexural mode;
R = disk radius;
S = half of the extent of the finished flaw parallel to the disk surface;
$\Phi$ = disk shaft tilt angle;
$B_Y$ = flaw wave height;
$\alpha$ = maximum flaw rise angle.

In flexible disk grinding, a good finish results from the simultaneous maintenance of conditions (1) and (2), and a poor finish can result from violation of either or both conditions. Condition (1) addresses a relation between disk spin-speed and the parameters (elastic modulus, disk density, disk thickness, radial location of grinding spot) determining disk stiffness. Condition (2) addresses the attitude, as characterized by a tilt angle, of the grinding disk with respect to the work. The invention, in any of its forms makes it easier to attain and maintain condition (1) (only). That is to say, condition (1) is satisfied over a wider speed range or to some (substantially) lower speed if the invention, in any of its forms, is in use, as compared to use of a conventional disk.

Thus it is a purpose of this invention to make it easier to attain and maintain the condition (1) while grinding. This is done by expanding the combinations of conditions under which condition (1) obtains; in particular, by changing design details of grinding disks so that terms or parameters in the numerator of the left side of relation (1) are decreased and/or so those in the denominator are increased. Such changes may include any combination, or all of the following: weighting the grinding-active portion of the disk by means of use of polymeric matrix materials filled with high-density fillers such as e.g. tungsten powder to increase effective value of $\rho$; reinforcing the disk radially and/or circumferentially to increase the in-plane tensile-strength of the disk, by filamental means or other means such as shims, thin spokes, etc. This means permits an increase in rotational speed or an increase in disk radius R, itself allowing an increase in grinding radius r; thinning or eliminating portions of a disk which are not involved in the grinding to reduce h in disk regions where grinding is not typically done; eliminating portions of a disk which are not involved in the grinding, except for thin tension members with nugatory flexural stiffness, such as filamental or shim-like radially-disposed "spokes".

The aforesaid novel grinding disks and method of the invention may be contrasted with the grinding disk of U.S. Pat. Nos. 1,701,669 and 1,666,746. Although these patents illustrate inner disk structures which are more flexible than outer annular grinding portions, they do not additionally include an outer annular facial portion having sufficient flexibility to enable such portion to be substantially deformed by the workpiece upon contact therewith. The outer annular grinding stones of these patents are rigid, and will not conform to the workpiece in the manner illustrated in FIG. 4. Also, in contrast to the teachings of this invention, U.S. Pat. No. 4,549,372 issued to Sexton et al. teaches the provision of a flexible support for the side edge portion of a grinding disk to enable it to be displaced radially, rather than in a direction transverse to the disk plane.

Although specific features of the invention are shown in some drawings and not others, this is for convenience only as each feature may be combined with any or all of the other features in accordance with the invention.

The term "grinding disk" as used herein is intended to include disks sold without abrasive material, if it is intended that abrasive sheets are to be subsequently affixed or adhered thereto, in accordance with common practice.

Other embodiments will occur to those skilled in the art and are within the following claims:

What is claimed is:

1. A grinding disk for rotating at very high spin speeds and having a low static flexural stiffness for grinding irregularities upon a workpiece, comprising:

a highly flexible inner portion having radially extending elongated members for increasing membrane disk strength by reinforcing the disk radially to increase the in-plane tensile strength of the disk to enable said disk to be driven at very high spin speeds without being damaged by centrifugal forces within said disk, said elongated members being sufficiently thin and flexible to provide minimal flexural stiffness in a direction transverse to the plane of the disk to enhance disk deflection when placed on the workpiece; and a flexible outer face portion for bearing an abrasive surface thereon.

2. The grinding disk of claim 1 in which said outer face portion is of lesser flexibility than said inner portion, yet sufficiently flexible to enable said outer portion to be substantially deformed by the irregularities upon said workpiece.

3. The grinding disk of claim 1 in which said inner portion includes a central hub portion and said outer face portion is coupled to said hub portion solely by said elongated members.

4. The grinding disk of claim 1 in which said inner portion includes flexible material and said elongated members lies within said flexible material.

5. The grinding disk of claim 4 in which said elongated members extends into said outer face portion.

6. The grinding disk of claim 1 further including circumferentially extending elongated members for increasing membrane disk strength, to enable said disk to be driven at very high spin speeds, said circumferentially extending means being sufficiently thin and flexible to provide minimal flexural stiffness.

7. The grinding disk of claim 6 in which said circumferentially extending elongated members includes a plurality of filamental elements.

8. A grinding disk for rotating at very high spin speeds, said disk having a low static flexural stiffness for grinding irregularities upon a workpiece, comprising:

a highly flexible inner portion;

an outer face portion for bearing an abrasive surface thereon, said outer face portion of lesser flexibility than said inner portion, yet sufficiently flexible to enable said outer portion to be substantially deformed by the irregularities upon said workpiece; and circumferentially extending reinforcing means for increasing membrane disk strength by increasing the in-plane tensile strength of said disk to enable said disk to be driven at very high spin speeds, said circumferentially extending means being sufficiently thin and flexible to provide minimal flexural stiffness in a direction transverse to the plane of the disk to enhance disk deflection when placed on the workpiece.

9. The grinding disk of claim 8 in which said circumferentially extending reinforcing means is a plurality of filamental elements disposed within said outer face portion.

10. A grinding disk having a low status flexural stiffness for grinding irregularities upon a workpiece, comprising:

a highly flexible inner portion;

a flexible outer face portion coaxially disposed about said inner portion for bearing an abrasive surface thereon;

a plurality of elongated members radially extending from said inner portion to said outer face portion for connecting said portions together; and weighting means for substantially increasing the average density of said outer face portion while negligibly affecting the flexibility of the disk.

11. The grinding disk of claim 10 in which said weighting means includes a high-density filler material disposed in said outer face portion.

12. The grinding disk of claim 11 in which said filler material includes metal powder.

13. The grinding disk of claim 11 in which said outer face portion is of lesser flexibility than said inner portion, yet sufficiently flexible to enable said outer portion to be substantially deformed by the irregularities upon said workpiece.

14. A grinding disk having a low static flexural stiffness for rotating at very high spin speed and for grinding irregularitiies upon a workpiece comprising:

a central hub portion;

an outer annular disk portion coaxially aligned with said central hub portion;

abrasive material secured to the surface of said outer annular disk; and a plurality of elongated members connected to and arranged about said central hub portion in a spoke like configuration for connecting said outer annular portion to said central hub portion.

15. The grinding disk of claim 14 in which said outer face portion is of lesser flexibility than said inner portion, yet sufficiently flexible to enable said outer portion to be substantially deformed by the irregularities upon said workpiece.

16. The grinding disk of claim 14 in which said elongated members are bonded into the medial plane of the outer annular portion to provide an increased membrane disk strength and to enable the disk to be driven at very high spin speeds without being torn apart by centrifugal forces within the disk.

17. The grinding disk of claim 14 in which said elongated members are sufficiently thin and flexible to provide minimal flexural stiffness.

* * * * *